US005785121A

United States Patent [19]

Dallas

[11] Patent Number: 5,785,121

[45] Date of Patent: Jul. 28, 1998

[54] BLOWOUT PREVENTER PROTECTOR AND METHOD OF USING SAME DURING OIL AND GAS WELL STIMULATION

[76] Inventor: L. Murray Dallas, 801 New England Ct., Allen, Tex. 75002

[21] Appl. No.: 661,995

[22] Filed: Jun. 12, 1996

[51] Int. Cl.[6] ..... E21B 33/03

[52] U.S. Cl. ..... 166/90.1; 137/375

[58] Field of Search ..... 166/85.4, 177.5, 166/90.1, 85.3, 75.11; 137/375; 251/120

[56] References Cited

U.S. PATENT DOCUMENTS

| | | | |
|---|---|---|---|
| 3,561,531 | 2/1971 | Miller . | |
| 3,738,426 | 6/1973 | Drouin . | |
| 3,830,304 | 8/1974 | Cummins . | |
| 4,111,261 | 9/1978 | Oliver . | |
| 4,241,786 | 12/1980 | Bullen . | |
| 4,512,410 | 4/1985 | Forester . | |
| 4,513,816 | 4/1985 | Hubert . | |
| 4,632,183 | 12/1986 | McLeod . | |
| 4,703,807 | 11/1987 | Weston . | |
| 4,832,128 | 5/1989 | Light et al. | 166/90.1 |
| 4,867,243 | 9/1989 | Garner et al. . | |
| 4,993,488 | 2/1991 | McLeod | 166/90.1 X |
| 5,012,865 | 5/1991 | McLeod | 166/90.1 |
| 5,114,158 | 5/1992 | Le . | |
| 5,205,356 | 4/1993 | Bridges et al. . | |
| 5,332,044 | 7/1994 | Dallas et al. . | |
| 5,372,202 | 12/1994 | Dallas et al. . | |
| 5,394,943 | 3/1995 | Harrington . | |
| 5,540,282 | 7/1996 | Dallas . | |
| 5,615,739 | 4/1997 | Dallas . | |

FOREIGN PATENT DOCUMENTS

| | | |
|---|---|---|
| 1277230 | 12/1990 | Canada . |
| 1281280 | 3/1991 | Canada . |
| 1292675 | 12/1991 | Canada . |
| 2055656 | 4/1992 | Canada . |
| 1302235 | 6/1992 | Canada . |

*Primary Examiner*—William P. Neuder
*Attorney, Agent, or Firm*—Dority & Manning, P.A.

[57] ABSTRACT

An apparatus for protecting blowout preventers during well fracturing and/or stimulation procedures is disclosed. The apparatus includes a hollow spool with spaced-apart inner and outer sidewalls that define an annular cavity. A mandrel is forcibly reciprocatable in the cavity. The apparatus is mounted above a BOP attached to a casing of the well before well stimulation procedures are begun. The mandrel is stroked down through the BOP to protect it from direct contact with the well stimulation fluids, especially abrasive proppants. The advantage is a simple, easy to operate apparatus for protecting BOPs which provides full access to the well casing with well servicing tools to facilitate well stimulation at moderate pressures.

23 Claims, 2 Drawing Sheets

BLOWOUT PREVENTER PROTECTOR AND METHOD OF USING SAME DURING OIL AND GAS WELL STIMULATION

The present invention relates to equipment for servicing oil and gas wells and, in particular, to apparatus for protecting blowout preventers from direct exposure to abrasive and/or corrosive fluids during well fracturing and/or stimulation procedures and a method of servicing oil and gas wells using same.

BACKGROUND OF THE INVENTION

The servicing of oil and gas wells to stimulate production requires the pumping of fluids under high pressure. The fluids are generally corrosive and/or abrasive because they are laden with abrasive proppants such as sand. Some hydrocarbon producing formations require stimulation at extreme pressures to improve the flow of hydrocarbons. In such wells, it is advantageous to use specialized tools called wellhead isolation tools which are inserted through the wellhead and related equipment to isolate pressure sensitive components from the extreme pressures required to stimulate those wells. Wellhead isolation tools are taught, for example, in U.S. Pat. Nos. 4,867,243, 5,332,044 and 5,372,202.

In other wells, stimulation to improve production can be accomplished at more moderate pressures which may be safely contained by blowout preventers (BOPs) attached to the well casing. In such situations, some operators remove the wellhead equipment and pump stimulation fluids directly through a valve attached to the BOPs. This procedure is adopted to minimize expense and to permit full access to the well casing with tools such as logging tools, perforation guns and the like during the well servicing operation. When pumping abrasive fluids into a well, the pump rate must be kept high to place the proppant without "screening out", in which a blockage occurs and all the equipment including the high pressure lines are blocked with abrasives injected under high pressure. When the pump rate is high or large quantities of proppant are pumped, the BOPs may be damaged by the cutting action of the proppant. If high rates of abrasive proppant are pumped through a BOP, the blind rams of the BOP or the valve gates can be "washed out" so that the BOP becomes inoperable.

In addition to wellhead isolation tools, casing savers are also used to protect wellhead equipment from extreme pressures and well stimulation fluids. Casing packers as described in U.S. Pat. No. 4,939,488 which issued Feb. 19, 1991 to McLeod have likewise been used. While casing savers and packers are useful in protecting wellhead equipment including BOPs, they have the disadvantage of restricting access to the casing because they constrict the through bore diameter from the high pressure valve to the casing. This restricts flow which can limit the pump rate. It also interferes with running servicing tools such as perforating guns, plug setters, or other related equipment into the casing. It is advantageous to be able to run tools during well servicing operations so that multi-zone wells can be serviced in a single set without changing the wellhead or wellhead isolation equipment. Furthermore, the well casing packer taught by McLeod can only be set in a well which is not under pressure at the beginning or end of a servicing operation. It cannot be used in wells with any natural pressure, and is therefore very limited in its utility.

If stimulation treatments are to exceed pressures at which the wellhead equipment is rated, a wellhead isolation tool, a casing saver or a well casing packer must be used to isolate the wellhead from extreme pressure and abrasion. As noted above, it is not uncommon, however, for certain wells to be stimulated at pressures which do not exceed the pressure rating of the wellhead equipment (usually about 5000 psi). When this is the case, well stimulation can be accomplished directly through the BOPs, but unless the BOPs are protected from the abrasive and/or caustic fluids used in the stimulation processes, there is considerable risk that the BOPs will be damaged and may be damaged to an extent that the well must be killed and the BOPs replaced because they are no longer functional.

It is therefore a primary object of the invention to provide a protector for a BOP which will protect the BOP from damage due to direct exposure to abrasive proppants and/or caustic stimulation fluids.

It is a further object of the invention to provide a protector for a BOP which protects the BOP from well stimulation fluids without restricting access to the well casing so that well servicing tools such as perforating guns, plug setters, or other related equipment can be run into and out of the well while the protector for the BOP is in place.

It is yet a further object of the invention to provide a protector for a BOP which is simple to manufacture and easy to use.

SUMMARY OF THE INVENTION

These and other objects of the invention are realized in an apparatus for protecting a blowout preventer during a well treatment procedure to stimulate production, comprising:

a spool having a top end, a bottom end, and spaced-apart inner and outer sidewalls that extend between the top end and the bottom end thereof;

the spool adapted to be mounted in an operative position above a blowout preventer by the spool bottom end and beneath a high pressure valve by the spool top end; and a mandrel having a top end and a bottom end, the top end being received in an annular cavity between the inner and outer sidewalls of the spool, in the operative position, so that the mandrel is reciprocally movable within the cavity between an upward position, in which the mandrel is withdrawn from the blowout preventer, and a downward position, in which the mandrel extends at least partially into the blowout preventer to protect operative parts of the blowout preventer during the treatment procedure.

In accordance of a further aspect of the invention, there is provided a method of treating a well to stimulate production, the well including at least one blowout preventer, comprising the steps of:

a) mounting above the blowout preventer an apparatus including a spool having a top end, a bottom end, and the spool adapted to be mounted in an operative position above a blowout preventer by the spool bottom end and beneath a high pressure valve by the spool top end, and a mandrel having a top end and a bottom end, the top end being received in an annular cavity between the inner and outer sidewalls of the spool, in the operative position, so that the mandrel is reciprocally movable within the cavity between an upward position, in which the mandrel is withdrawn from the blowout preventer, and a downward position, in which the mandrel extends at least partially into the blowout preventer to protect operative parts of the blowout preventer during the treatment procedure;

b) mounting a high pressure valve above the apparatus;

c) connecting a high pressure line to the high pressure valve and pumping pressurized fluid into the well to ensure that a fluid tight seal exists between the blowout preventer and the apparatus and between the apparatus and the high pressure valve;

d) closing the high pressure valve;

e) fully opening the blowout preventer;

f) stroking the mandrel of the apparatus through the blowout preventer;

g) treating the well to stimulate production;

h) stroking the mandrel out of the blowout preventer;

i) closing the blowout preventer;

j) bleeding off fluid pressure in the high pressure line;

k) removing the high pressure line and the high pressure valve; and l) removing the apparatus.

The apparatus in accordance with the invention comprises a spool which may be mounted above a blowout preventer that is mounted to a well casing. The spool includes inner and outer concentric walls which are spaced apart to form an annular cavity that accommodates a mandrel having a top end that is forcibly reciprocatable within the cavity using fluid pressure. A top end of the spool is adapted for the attachment of a high pressure valve or spool header through which well stimulation fluids can be pumped.

The spool for protecting BOPs in accordance with the invention can be used in a novel method of servicing wells which permits other tools such as perforating guns, plugs, plug setting tools, fishing tools and related equipment to be used during the well servicing operation, thus permitting the servicing of multi-zone wells to proceed without interruption. This is an important advantage because it obviates the necessity of having service rigs set up and taken down for each production zone of a multi-zone well.

BRIEF DESCRIPTION OF THE DRAWINGS

The invention will now be explained in more detail by way of example only, and with reference to the following drawings, wherein.

DETAILED DESCRIPTION OF THE PREFERRED EMBODIMENT

Figure 1:
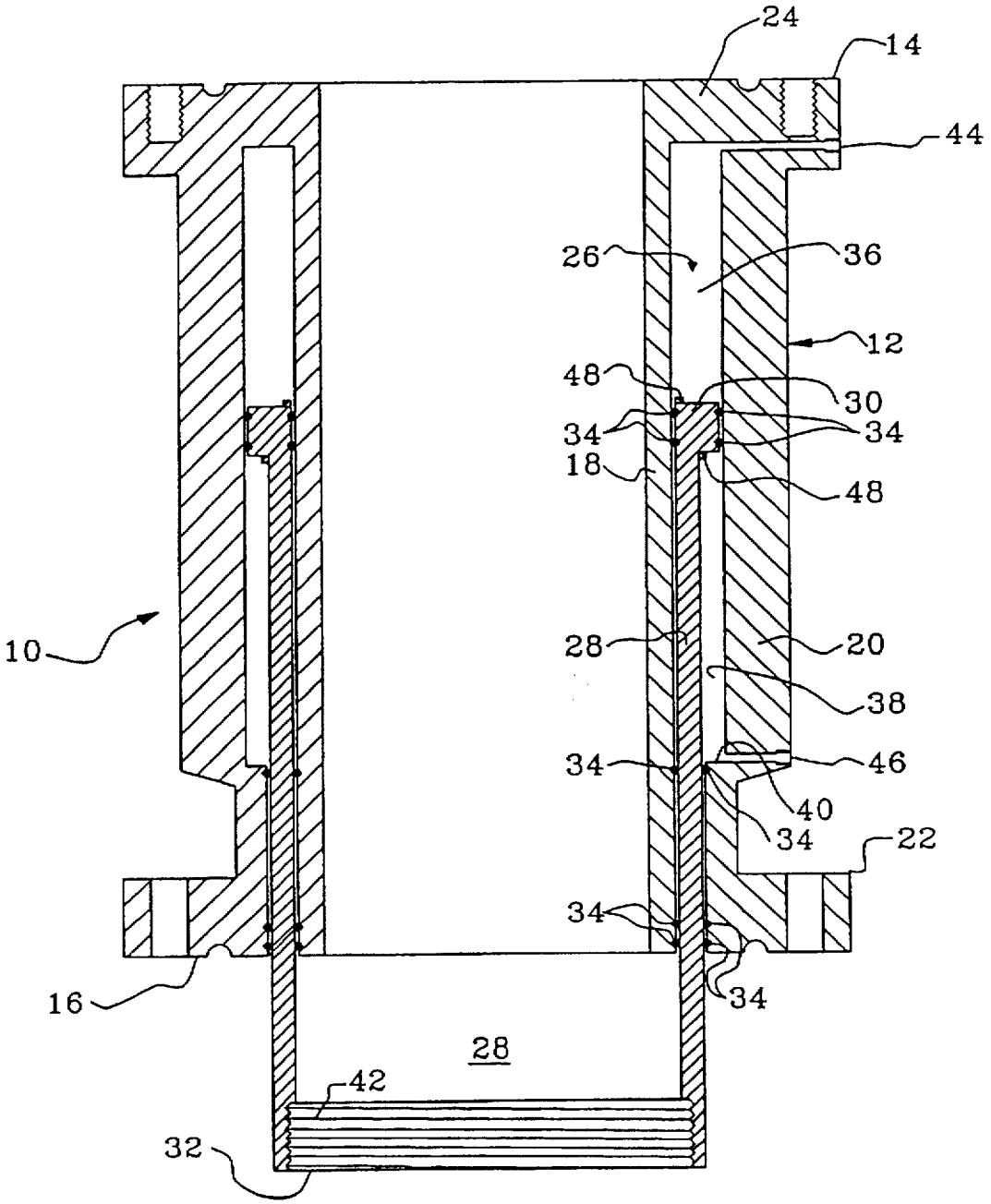
FIG. 1 shows a longitudinal cross-sectional view of a blowout preventer protector in accordance with the invention, showing the mandrel in a partially stroked-out position.

FIG. 1 shows a cross-sectional view of the apparatus for protecting BOPs (hereinafter BOP protector) in accordance with the invention, generally indicated by the reference 10. The apparatus includes a hollow spool 12 having a top end 14 and a bottom end 16 with an inner sidewall 18 and an outer sidewall 20 arranged in a space-apart relationship. The bottom end 16 includes a bottom flange 22 which is adapted for fluid tight connection with a top end of a BOP or a casing spool, as will be explained below in further detail. The top end 14 includes a top flange 24 which is adapted for attachment in a fluid tight relationship to a high pressure valve or a spool header, as will also be explained in more detail below. The top flange 24 is connected, preferably by welding or the like, to the inner sidewall 18 and the outer sidewall 20 to form an annular cavity 26 that preferably extends from the bottom end 16 to the top flange 24. A mandrel 28 having a top end 30 and a bottom end 32 is received in the annular cavity 26 and forcibly reciprocatable within the cavity. The top end 30 of the mandrel 28 preferably has an inverted L-shape and extends across the annular cavity 26. A pair of O-rings 34 are retained on opposite sides of the top end 30 of the mandrel 28 to provide a fluid resistant seal between the mandrel 28 and the walls of the annular cavity 26 to form an upper chamber 36 and a lower chamber 38 of respectively variable volumes which change as the mandrel 28 is forcibly reciprocated within the annular cavity 26. A step 40 in the annular cavity 28 forms a constriction to facilitate sealing the lower chamber 38 to inhibit fluid from leakage around the bottom end 16 of the spool 12. Spaced below the step 40 are a pair of O-rings 34 retained in the inner surface of the inner sidewall 18 and the outer sidewall 20. Likewise, positioned adjacent the bottom end 16 is a second set of O-rings 34 to inhibit the migration of abrasive and corrosive fluids, to which the mandrel 28 is exposed, into the lower chamber 38. Preferably, the mandrel 28 is dimensioned in length so that when the top end 30 of the mandrel is reciprocated to a top of the chamber 26, the lower end 32 of the mandrel is positioned above the set of O-rings 34 adjacent the bottom wall 16 to permit those O-rings to be changed because they are the set of O-rings most prone to wear due to their exposure to corrosive and/or abrasive substances. An internal thread connector 42 on the bottom end 32 of the mandrel 28 is adapted for the connection of mandrel extension sections having the same diameter as the diameter of the mandrel 28. The extension sections (not illustrated) permit the mandrel 28 to be lengthened in case a header spool (not illustrated) or the like is located between the mandrel 28 and a BOP to be protected. The connector 42 may likewise be an external thread, or any other type of secure connecting arrangement.

The outer sidewall 20 of the spool 12 further includes a first port 44 for injecting pressurized fluid into the upper chamber 36 of the annular cavity 26 to forcibly stroke the mandrel 28 downwardly. The outer sidewall 20 also includes a second port 46 for injecting pressurized fluid into the lower chamber 38 to stroke the mandrel upwardly in the annular cavity 26. Attached to a top surface of the top end 30 of the mandrel 28 is a rib 48 which acts as a spacer to ensure that when the mandrel is at the top of its stroke, pressurized fluid can be injected into the cavity 26 to stroke the mandrel downwardly. A corresponding rib 48 is located on the bottom surface of the top end of the mandrel 28 and serves the same purpose. In order to stroke the mandrel upwardly and downwardly, pressurized fluid lines are connected to the first port 44 and the second port 46. The pressurized fluid is preferably a hydraulic fluid but may also be, for example, compressed air. If hydraulic fluid is used for stroking the mandrel upwardly and downwardly in the annular cavity 26, a small hydraulic hand pump may be used or hydraulic pump lines may be connected to the first port 44 and the second port 46. In either case, pressurized fluid is introduced into one port and fluid is drained from the other port as the mandrel is stroked upwardly or downwardly in the annular cavity 26.

Figure 2:
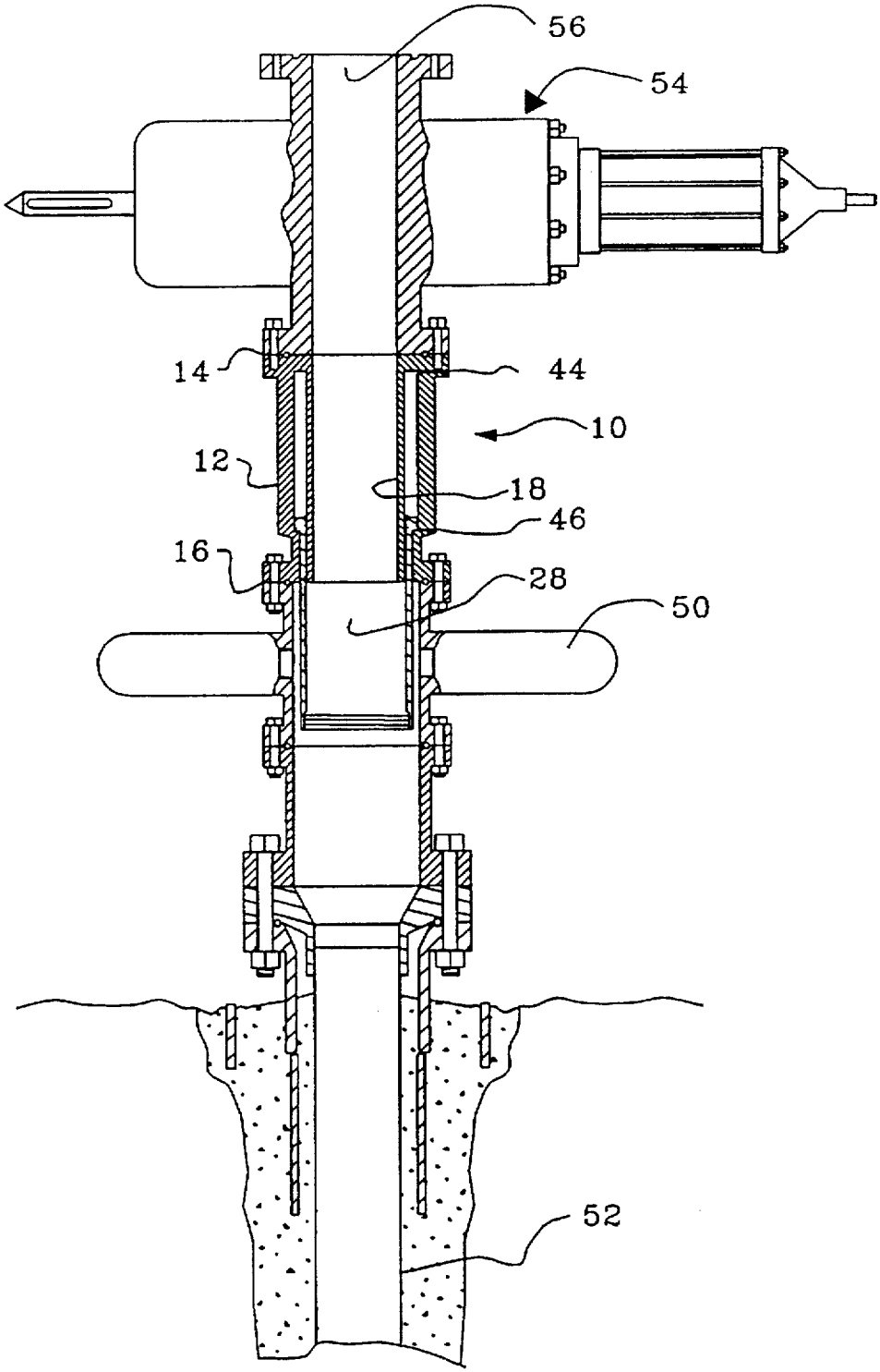
FIG. 2 shows a cross-sectional view of the blowout preventer protector shown in FIG. 1 attached to a blowout preventer on a wellhead and in a position for performing well stimulation procedures.

FIG. 2 shows the BOP protector 10 in accordance with the invention mounted to a BOP 50 which is in turn connected to a well casing 52 by various casing headers and hangers, well known in the art. The BOP 50 is a piece of wellhead equipment that is well known in the art and its construction and function do not form a part of this invention. The BOP 50 and related spools and hangers are therefore shown schematically and are not described. Mounted above the BOP protector 10 is a high pressure valve 54. The high pressure valve 54 is preferably a hydraulically operated valve having a pressure rating that is at least as high as the pressure rating of the BOP 50, and a passage 56 having a diameter that is at least as large as the internal diameter of the casing 52 to permit oil and gas well servicing tools to be inserted through the valve 54 and into the well casing 52.

As is apparent, the inner sidewall 18 of the BOP protector 10 has an internal diameter which is substantially equal to the diameter of the casing 52. As shown in FIG. 2, the mandrel 28 has been stroked downwardly through the BOP 50 and the well is ready to be serviced. The annular passage defined by the inner sidewall 18 of the BOP protector 10 and the casing 52 is unrestricted so that tools such as perforating guns, plug setters, logging tools, fishing tools and the like may be inserted through the BOP protector 10 and into the casing 52. This permits wells with more than one production zone to be serviced without interruption which is a distinct advantage over prior art casing savers and well casing packers that restrict access to the casing due to a constriction of the diameter of the passage between a high pressure valve 54 and the casing 52.

The invention also provides a method of fracturing or stimulating a well having a blowout preventer 50 located above the casing 52 using the BOP protector 10 in accordance with the invention. In accordance with the method, the BOP protector 10 is mounted above the BOP 50 and a high pressure valve 54 is mounted above the BOP protector 10. The high pressure valve 54, commonly called a "frac" valve, is well known in the art and its structure and function will not be further explained. A high pressure line (not illustrated) is connected to the high pressure valve and pressurized fluid is pumped into the BOP protector 10 while the BOP 50 is still closed to ensure that a fluid tight seal exists between the BOP 50 and the BOP protector 10, as well as between the BOP protector 10 and the high pressure valve 54. If no pressure leaks are detected between the top end 14 or the bottom end 16 of the spool 12, the high pressure valve 54 is closed and the BOP 50 is fully opened. Pressurized fluid is injected through the first port 44 using a pneumatic or hydraulic line attached to that port, and drained from the second port 46 using a pneumatic or hydraulic line. The pressurized fluid strokes the mandrel 28 down through the BOP 50. When the mandrel 28 reaches a bottom of its stroke, the pressure in the pressurized fluid injected into the first port 44 rises dramatically to indicate that the mandrel 28 has reached the bottom of its stroke and the well is ready for servicing. Stimulation or fracturing of the well may then commence by pumping abrasive and/or corrosive fluids through a high pressure line (not illustrated) attached to the high pressure valve 54.

If the well being serviced has several production zones, the stimulation process may proceed sequentially from zone to zone because tools such as logging tools, perforating guns, plug setters and other well servicing tools (not illustrated) can be introduced through the high pressure valve 54 and inserted directly into the well casing 52 without removing the BOP protector 10. In general, multi-zone wells are stimulated one production zone at a time from the bottom of the well up. This is usually accomplished in a sequence which includes logging the production zone; inserting a plug in the casing at a bottom of the production zone; perforating the casing in the area of the production zone, if necessary; stimulating the production zone by fracturing and/or acidizing or the like; and, flowing back the stimulation fluids before recommencing the process for the next production zone. The ability to perform all these operations with the BOP protector 10 in place greatly facilitates well service operations and contributes significantly to the economy of servicing wells. After the last production zone of a well has been serviced, the fracturing and/or stimulating fluids may be flowed back through the high pressure valve 54 before the BOP protector 10 is removed from the BOP 50 or after the BOP protector 10 is removed from the BOP 50, as the operator chooses. In either case, when the BOP protector 10 is no longer needed, the mandrel 28 is stroked upwardly out of the BOP 50 by injecting pressurized fluid into the second port 46 while draining it from the first port 44 until a dramatic rise in the resistance to the injected pressurized fluid indicates that the mandrel 28 is completely stroked out of the BOP 50. The BOP 50 is then closed, the high pressure valve 54 is removed from the top of the BOP protector 10 and the BOP protector 10 is removed from the BOP 50. A wellhead or other terminating equipment can then be mounted to the BOP 50 and normal hydrocarbon production can commence or resume. Since the mandrel 28 protects the BOP 50 from direct contact with abrasive and/or corrosive fluids used during the well stimulation process, the BOP 50 is not damaged and there is no risk that the blind rams or the tubing rams of the BOP 50 will be "washed out" by the abrasive action of a high volume of proppants pumped into the well. Since damage to BOPs is eliminated and the risk of having to kill or plug the well before and after treatment is obviated, the present invention contributes significantly to the economy of well stimulation treatments conducted at moderate fluid pressures.

Modifications and improvements to the above described embodiment of the invention may become apparent to those skilled in the art. The foregoing description is intended to be exemplary rather than limiting. The scope of the invention is therefore intended to be limited solely by the scope of appended claims.

I claim:

1. Apparatus for protecting a blowout preventer during a well treatment procedure to stimulate production, comprising:

a spool having a top end, a bottom end, and spaced-apart inner and outer sidewalls that extend between the top end and the bottom end thereof;

the spool adapted to be mounted in an operative position above a blowout preventer by the spool bottom end and beneath a high pressure valve by the spool top end; and a mandrel having a top end and a bottom end, the top end being received in an annular cavity between the inner and outer sidewalls of the spool, in the operative position, so that the mandrel is reciprocally movable within the cavity between an upward position, in which the mandrel is withdrawn from the blowout preventer, and a downward position, in which the mandrel extends at least partially into the blowout preventer to protect operative parts of the blowout preventer during the treatment procedure.

2. Apparatus for protecting a blowout preventer during a well treatment procedure to stimulate production as claimed in claim 1 wherein the top end includes a flange that is connected in a fluid tight relationship with the inner and the outer sidewalls of the spool.

3. Apparatus for protecting a blowout preventer during a well treatment procedure to stimulate production as claimed in claim 2 wherein the bottom end includes a flange that is connected to only the outer sidewall of the spool.

4. Apparatus for protecting a blowout preventer during a well treatment procedure to stimulate production as claimed in claim 3 wherein the annular cavity between the inner and outer sidewalls extends from the top flange through the bottom flange of the spool.

5. Apparatus for protecting a blowout preventer during a well treatment procedure as claimed in claim 1 wherein the annular cavity is constricted above the bottom flange to facilitate sealing the annular cavity and to prevent the mandrel from being ejected from the annular cavity in the downward position.

6. Apparatus for protecting a blowout preventer during a well treatment procedure to stimulate production as claimed in claim 1 wherein the bottom end of the mandrel is adapted to permit the connection of mandrel extension sections to permit the length of the mandrel to be elongated.

7. Apparatus for protecting a blowout preventer during a well treatment procedure to stimulate production as claimed in claim 1 wherein the mandrel includes a first port located at a top of the annular cavity, and a second port located at a bottom of the annular cavity, to receive fluid under pressure therethrough into the cavity to move the mandrel within the cavity.

8. Apparatus for protecting a blowout preventer during a well treatment procedure to stimulate production as claimed in claim 1 wherein an internal diameter of the mandrel is substantially equal to an internal diameter of a well casing.

9. Apparatus for protecting a blowout preventer during a well treatment procedure to stimulate production, comprising:

a hollow spool having a top end, a bottom end, and spaced-apart inner and outer sidewalls that extend between the top end and the bottom end thereof, the spool adapted to be mounted in an operative position above a blowout preventer and beneath a high pressure valve;

the bottom end including a flange adapted for attachment in a fluid tight relationship above the blowout preventer, the flange being affixed to the outer sidewall of the hollow spool;

the top end including a flange adapted for attachment in a fluid tight relationship below the high pressure valve, the flange being affixed to both the inner and the outer sidewalls of the hollow spool so that an annular cavity that extends from the top flange through the bottom end is formed between the inner and outer sidewalls;

a mandrel having a top end and a bottom end, the top end being received in the annular cavity of the spool in the operative position so that the mandrel is forcibly reciprocatable within the cavity between an upward position, in which the mandrel is withdrawn from the blowout preventer, and a downward position, in which the mandrel extends at least partially into the blowout preventer to protect operative parts of the blowout preventer during the treatment procedure;

first sealing means for providing a fluid resistant seal between the top end of the mandrel and the respective inner and outer sidewalls so that the annular cavity is partitioned into upper and lower chambers of respectively variable volumes;

second sealing means for providing a fluid resistant seal between the mandrel and the bottom end of the spool to inhibit pressurized fluid in the lower chamber from leaking from that chamber; and a first port for injecting pressurized fluid into or draining pressurized fluid from the upper chamber and a second port for injecting pressurized fluid into or draining pressurized fluid from the lower chamber.

10. An apparatus for protecting blowout preventers as claimed in claim 9 wherein the inner sidewall of the spool has an internal diameter that is substantially equal to an internal diameter of a casing of the well.

11. An apparatus for protecting blowout preventers as claimed in claim 9 wherein the annular cavity is constricted at the bottom end of the spool to facilitate sealing the cavity with the second sealing means, and the top end of the mandrel is enlarged to prevent the mandrel from being ejected from the cavity when pressurized fluid is injected into the first port and drained from the second port.

12. An apparatus for protecting blowout preventers as claimed in claim 9 wherein the bottom end of the mandrel is adapted for the connection of extension sections to permit the length of the mandrel to be extended.

13. An apparatus for protecting blowout preventers as claimed in claim 9 wherein the first and second sealing means comprise O-rings.

14. An apparatus for protecting blowout preventers as claimed in claim 13 wherein the second sealing means comprises a first set of O-rings arranged on opposite sides of the mandrel remote from the bottom end of the spool and a second set of O-rings arranged on opposite sides of the mandrel adjacent the bottom end of the spool.

15. An apparatus for protecting blowout preventers as claimed in claim 13 wherein the mandrel is adapted to be stroked up past the second set of O-rings so that the O-rings in that set can be replaced.

16. An apparatus for protecting blowout preventers as claimed in claim 9 wherein the pressurized fluid is hydraulic fluid.

17. An apparatus for protecting blowout preventers as claimed in claim 9 wherein the pressurized fluid is compressed air.

18. A method of treating a well to stimulate production, the well including at least one blowout preventer, comprising the steps of:

a) mounting above the blowout preventer an apparatus including a spool having a top end, a bottom end, and spaced-apart inner and outer sidewalls that extend between the top end and the bottom end thereof, the spool adapted to be mounted in an operative position above a blowout preventer by the spool bottom end and beneath a high pressure valve by the spool top end, and a mandrel having a top end and a bottom end, the top end being received in an annular cavity between the inner and outer sidewalls of the spool, in the operative position, so that the mandrel is reciprocally movable within the cavity between an upward position, in which the mandrel is withdrawn from the blowout preventer, and a downward position, in which the mandrel extends at least partially into the blowout preventer to protect operative parts of the blowout preventer during the treatment procedure;

b) mounting a high pressure valve above the apparatus;

c) connecting a high pressure line to the high pressure valve and pumping pressurized fluid into the well to ensure that a fluid tight seal exists between the blowout preventer and the apparatus and between the apparatus and the high pressure valve;

d) closing the high pressure valve;

e) fully opening the blowout preventer;

f) stroking the mandrel of the apparatus through the blowout preventer;

g) treating the well to stimulate production;

h) stroking the mandrel out of the blowout preventer;

i) closing the blowout preventer;

j) bleeding off fluid pressure in the high pressure line;

k) removing the high pressure line and the high pressure valve; and l) removing the apparatus.

19. A method of treating a well to stimulate production, the well including at least one blowout preventer, as claimed in claim 18 further including a step of running a logging tool attached to a wire line down the casing to log a second production zone of the well after treating a first zone of the well and before stroking the mandrel out of the blowout preventer.

20. A method of treating a well to stimulate production, the well including at least one blowout preventer, as claimed in claim 19 further including a step of inserting a plug in the casing between the first and second production zones of the well after logging the second production zone.

21. A method of treating a well to stimulate production, the well including at least one blowout preventer as claimed in claim 20 further including a step of inserting a perforating gun into the well after inserting the plug and perforating the casing in an area of the second production zone of the well located above the plug.

22. A method of treating a well to stimulate production, the well including at least one blowout preventer as claimed in claim 21 further including a step of treating the second production zone of the well to stimulate production.

23. A method of treating a well to stimulate production, the well including at least one blowout preventer as claimed in claim 22 of repeating the steps of logging, plugging, perforating and treating to stimulate production for all other production zones in the well before stroking the mandrel out of the blowout preventer.

* * * * *

UNITED STATES PATENT AND TRADEMARK OFFICE

CERTIFICATE OF CORRRECTION

PATENT NO. : 5,785,121
DATED : July 28, 1998
INVENTOR(S) : L. Murray Dallas It is certified that error appears in the above-identified patent and that said Letters Patent is hereby corrected as shown below:

On the title page, insert item [56]:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 0 | 7 | 6 | 0 | 7 | 9 | 02/28/78 | Herricks et al | | | |
| | | | | | | | | | | | | | |

Signed and Sealed this

Twenty-third Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,785,121
DATED : July 28, 1998
INVENTOR(S) : Dallas

It is certified that error appears in the above-identified patent and that said Letters Patent is hereby corrected as shown below:

Column 8, line 26, Claim 15, "claim 13" should read –claim 14 --

Signed and Sealed this

Twenty-sixth Day of December, 2000

*Attest:*

Q. TODD DICKINSON

*Attesting Officer*

*Director of Patents and Trademarks*